US005356012A

United States Patent [19]

Tang et al.

[11] Patent Number: 5,356,012

[45] Date of Patent: Oct. 18, 1994

[54] CONTAINER WITH COUNTER

[76] Inventors: Yi Tang; Hong Yang, both of 11140 Rose Ave. #414, Los Angeles, Calif. 90034

[21] Appl. No.: 59,216

[22] Filed: May 6, 1993

[51] Int. Cl.[5] ..... B65D 83/04; G09F 9/40

[52] U.S. Cl. ..... 206/534; 116/308; 116/315; 116/317; 206/459.1

[58] Field of Search ..... 206/534, 459.1; 116/308, 311, 312, 313, 315, 317, 306

[56] References Cited

U.S. PATENT DOCUMENTS

| | | | |
|---|---|---|---|
| 2,636,469 | 4/1953 | McKay | 116/315 X |
| 3,355,067 | 11/1967 | Espinol | 206/534 X |
| 3,440,999 | 4/1969 | Saferstein et al. | 116/317 X |
| 3,678,884 | 7/1972 | Robbins | 206/534 X |
| 3,688,945 | 9/1972 | Harman, Jr. et al. | 206/534 X |
| 4,165,709 | 8/1979 | Studer | 116/308 |
| 4,528,933 | 7/1985 | Allen | 116/308 |
| 4,753,189 | 6/1988 | Mastman et al. | 116/308 |

*Primary Examiner*—Bryon P. Gehman

[57] ABSTRACT

Container with counter comprising two cylindrical containers (1, 2) that one is placed coaxially inside the other, two saw-tooth structures (1*a*, 1*b*) and two sets of readings (1*c*, 1*d*) which are mounted on the outside surface of the inner cylindrical container (1), a window (2*a*) and a tenon with triangular cross section (2*b*) which are mounted on the outer cylindrical container (2), a cap (3) and a spring (4). When the container with counter is closed, the inner cylindrical container (1) is pushed in by the cap (3) and when the container with counter is opened, the inner cylindrical container (1) is partially pushed out by the spring (4). Accompanying these processes is a relative motion of the tenon (2*b*) along the saw-tooth structures (1*a*, 1*b*), which rotates the inner cylindrical container (1) and thus changes the reading shown from the window (2*a*). Alternatively, especially for large containers, a cylindrical structure (5) which replaces the inner cylindrical container (1), together with the saw-tooth structures (1*a*, 1*b*), the readings (1*c*, 1*d*), and the spring (4), is placed coaxially inside the cap (3). The saw-tooth structures (1*a*, 1*b*) are mounted on the outside surface of the cylindrical structure (5), the tenon (2*b*) is mounted on the side surface of the cap (3), and the window (2) is opened on the cap (3) where the readings (1*c*, 1*d*) are to be shown.

3 Claims, 5 Drawing Sheets

CONTAINER WITH COUNTER

BACKGROUND

1. Field of Invention

This invention relates to combinations of a container with a counter in such a way that the counter is triggered to advance every time the container is opened or closed which can thus record the number of times that the container has been opened or closed.

2. Description of Prior Art

There are situations that the number of times that the contents of a container have been taken out from the container is important, such as when one is taking one's medication. If the number of dispenses from one's medicine bottle is recorded, one can then know how many times one has taken one's medication. Obviously one can simply combine a container with a mechanical or an electronic counter to record the number of dispenses. However, this does not by itself optimize structural and operational simplicities, nor cost efficiency. This is especially true when two-digit readings are required, which is usually achieved by counters with two drums if mechanical counters are used. The major disadvantage for electronic counters, aside from their relatively high cost, is that they will fail to work when their batteries are gone.

OBJECTS AND ADVANTAGES

Objects and advantages of the present invention are:

(a) to provide a container with counter that the counter is triggered to advance every time the container is opened or closed which can thus record the number of its dispenses by counting the number of openings and closings of the container.

(b) to provide a container with counter whose counter is a mechanical one, has only a single drum and is able to show two-digit readings.

(c) to provide a container with counter that the capacity of the container is provided by the hollow drum of the counter.

(d) to provide a container with counter whose container can have any means for the closures of its cap.

(e) to provide a container with counter whose counter can be reset to any of its readings.

(f) to provide a container with counter whose counter can have different readings when the container is opened and closed.

(g) to provide a container with counter which, when used as a medicine bottle, can keep a record of the medication taken daily, weekly or monthly.

(h) to provide a container with counter that the entire system can be made through molding, especially if plastic materials are used. The spring can be made from either metal or plastics.

(i) to provide a container with counter whose counter can be alternatively incorporated with the cap of the container instead of with the container itself.

(j) to provide a container with counter which can optimize structural and operational simplicities, and cost efficiency.

DRAWING FIGURES

Figure 1A:
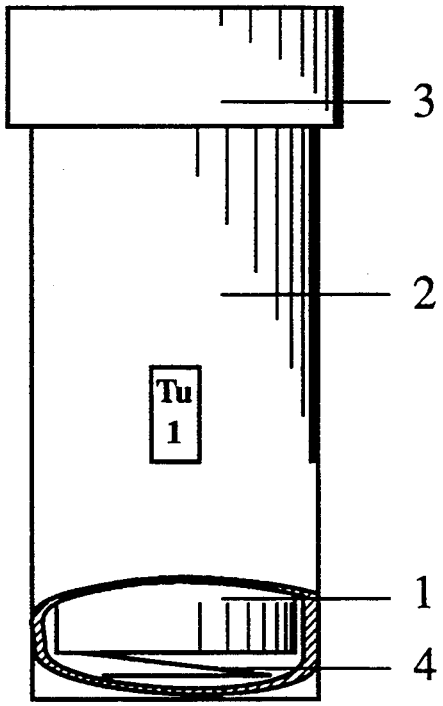
FIGS. 1A and 1B show side and cut-away views of a closed and an opened container with counter respectively.

| Reference Numerals in Drawings | |
|---|---|
| 1 inner cylindrical container | 1a saw-tooth structure |
| 1b saw-tooth structure | 1c readings of the counter |
| 1d readings of the counter | |
| 2 outer cylindrical container | |
| 2a window on the outer cylindrical container | |
| 2b tenon with triangular cross section | 2c neck of the container |
| 3 cap | 4 spring |
| 5 cylindrical structure | 6 circular plate |
| 7 handle of the circular plate | 8 grooves on the tenon |
| 9 cap of the tenon | |

DESCRIPTION FIGS. 1 TO 5

Figure 1B:
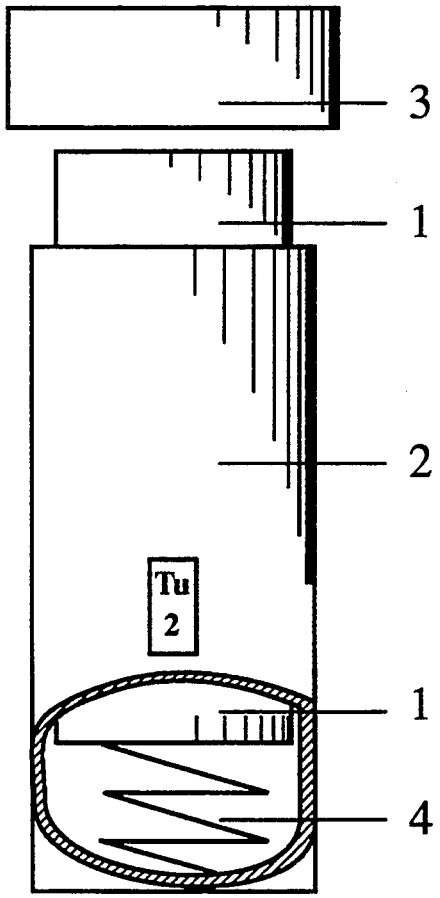
Figure 1C:
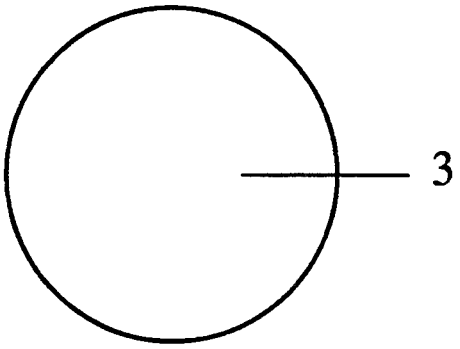
FIG. 1C shows a top view of the container with counter.
Figure 2:
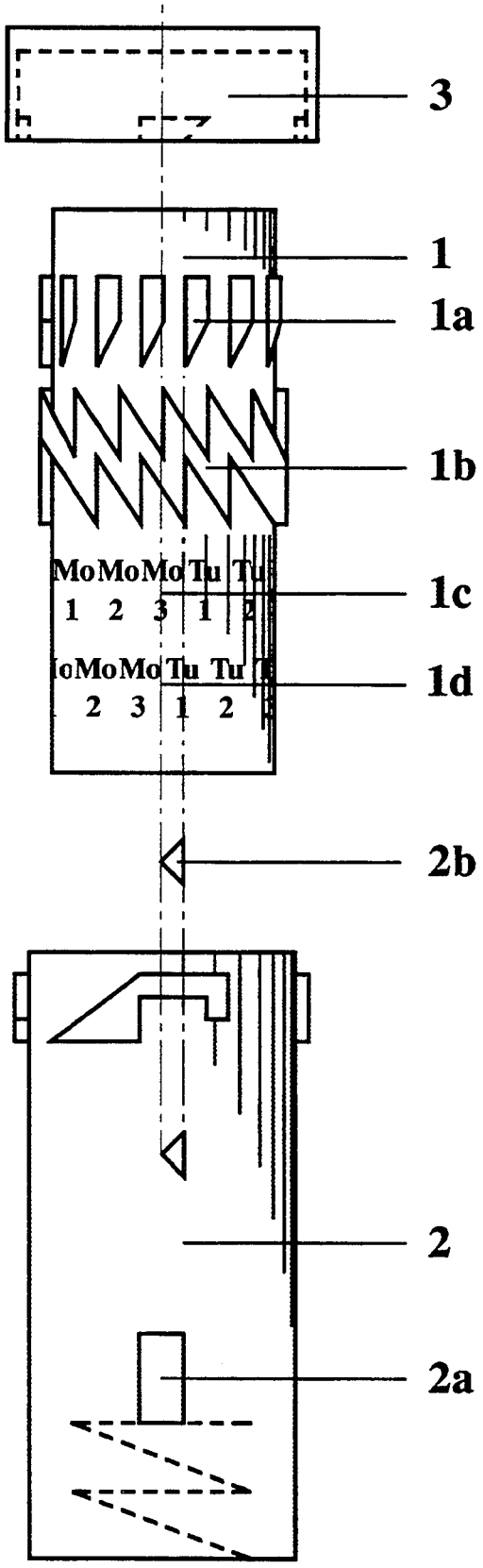
FIG. 2 shows an exploded view of the container with counter shown in FIG. 1.
Figure 3:
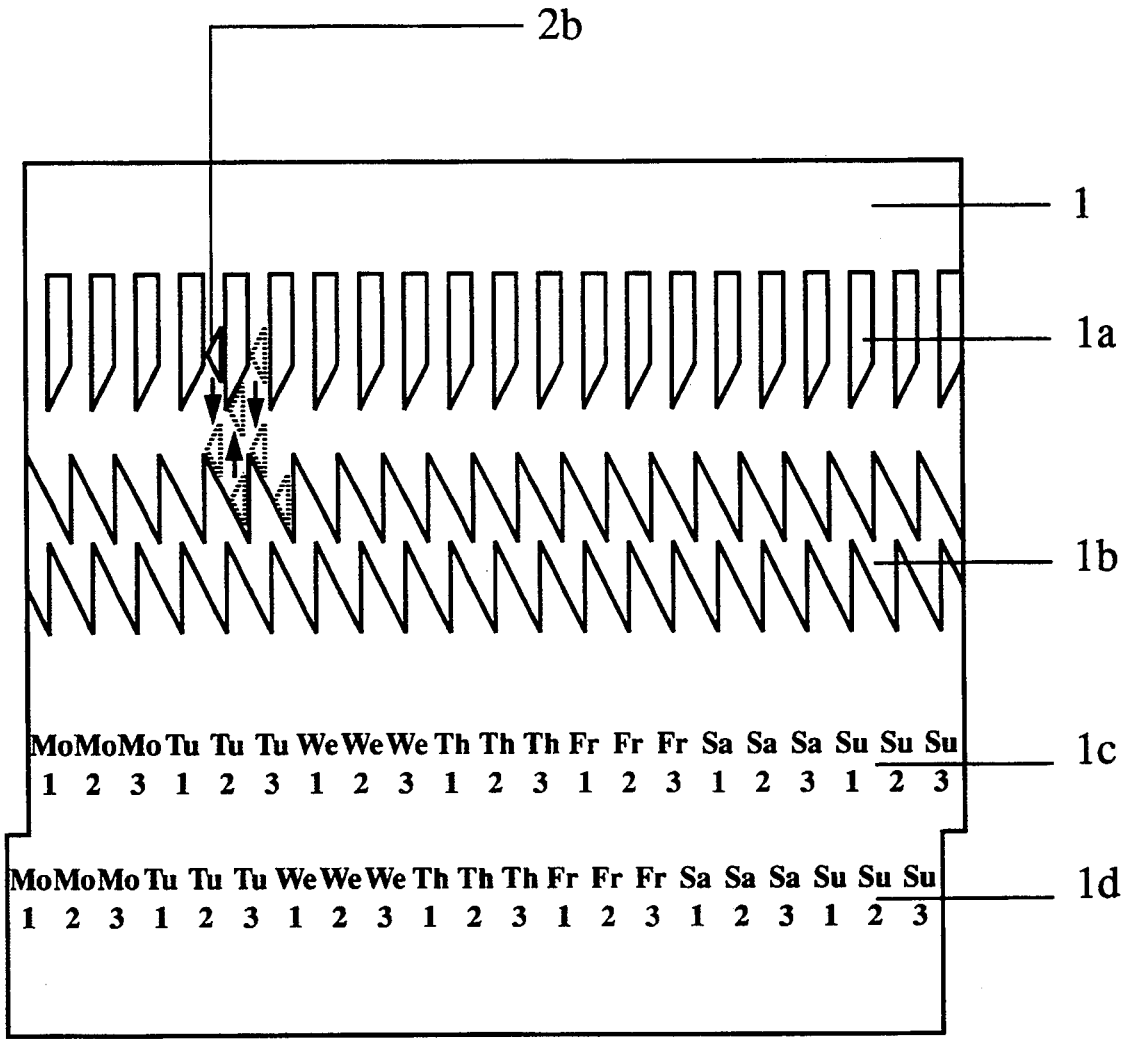
FIG. 3 shows an unfolded (or spread out) view of the inner cylindrical container of the container with counter shown in FIG. 2 and a relative motion of the tenon fixed to the outer cylindrical container with respect to the inner cylindrical container.

A typical embodiment of the present invention is illustrated in FIG. 1A (side and cut-away view with the entire container closed), FIG. 1B (side and cut-away view with the entire container opened), FIG. 1C (top view), FIG. 2 (exploded view) and FIG. 3 (unfolded or spread out view). The present invention comprises two cylindrical containers 1, 2 that one is placed coaxially inside the other, a cap 3 and a spring 4 (FIGS. 1A, 1B, 1C and 2). Two saw-tooth structures 1*a*, 1*b*, each comprising a saw-tooth zagged edge and equal number of teeth, and two sets of readings 1*c*, 1*d* are constructed on the outside surface of inner cylindrical container 1 (FIG. 2 and FIG. 3). A tenon with triangular cross section 2*b* is fixed to outer cylindrical container 2. Two saw-tooth structures 1*a*, 1*b* are constructed and mounted on the outside surface of inner cylindrical container 1 in such a way that one is approximately the mirror image of the other with respect to a planar mirror perpendicular to the cylindrical axis of inner cylindrical container 1 except that one is rotated around the axis by half of a tooth of saw-tooth structures 1*a*, 1*b*. Saw-tooth structures 1*a*, 1*b* together with inner cylindrical container 1 can undergo rotational motion around the cylindrical axis of inner cylindrical container 1 and translational motion along the axis under external forces. The two zagged edges of saw-tooth structures 1*a*, 1*b* form a gap in which tenon is with triangular cross section 2*b* confined. The zagged edges are in contact with and can slide along tenon with triangular cross section 2*b* (FIG. 2 and FIG. 3). One of the readings can be seen at a particular time through a window 2*a* on outer cylindrical container 2 (FIGS. 1A, 1B and 2). When the entire container is closed, one of readings 1*c* is shown from window 2*a*, and when the entire container is opened, one of readings 1*d* is shown from window 2*a*.

When the container with counter is closed, inner cylindrical container 1 is pushed in by cap 3, and when the container with counter is opened, inner cylindrical container 1 is partially pushed out by spring 4 (FIGS. 1 to 3). Accompanying these processes is a relative motion of tenon with triangular cross section 2*b* along the zagged edges of saw-tooth structures 1*a*, 1*b*, which rotates inner cylindrical container 1 clockwise and thus changes the reading shown from window *a*. When the container with counter is opened from the closed state and then is closed again, inner cylindrical container 1 is rotated clockwise by one reading. The reading shown from window 2*a* can be adjusted by pushing inner cylindrical container 1 half way into outer cylindrical container 2 and rotating the former counterclockwise.

The capacity of the container with counter is provided by inner cylindrical container 1 which also serves as the drum of the counter. The counter comprises inner cylindrical container 1, readings 1*c*, 1*d*, saw-tooth structures 1*a*, 1*b*, window 2*a* and tenon with triangular cross section 2*b*.

Readings 1*c*, 1*d* are just examples for the illustration. Alternative designs for readings 1*c*, 1*d*, e.g., continuous numbering, can be used for different purposes. The entire system can be made through molding, especially if plastic materials are used.

The container with counter can be used as a push button counter, if inner cylindrical container 1 is replaced by a cylindrical button. This push button counter can be used, for example, to record the number of openings and closings of a door or a drawer.

Figure 4:
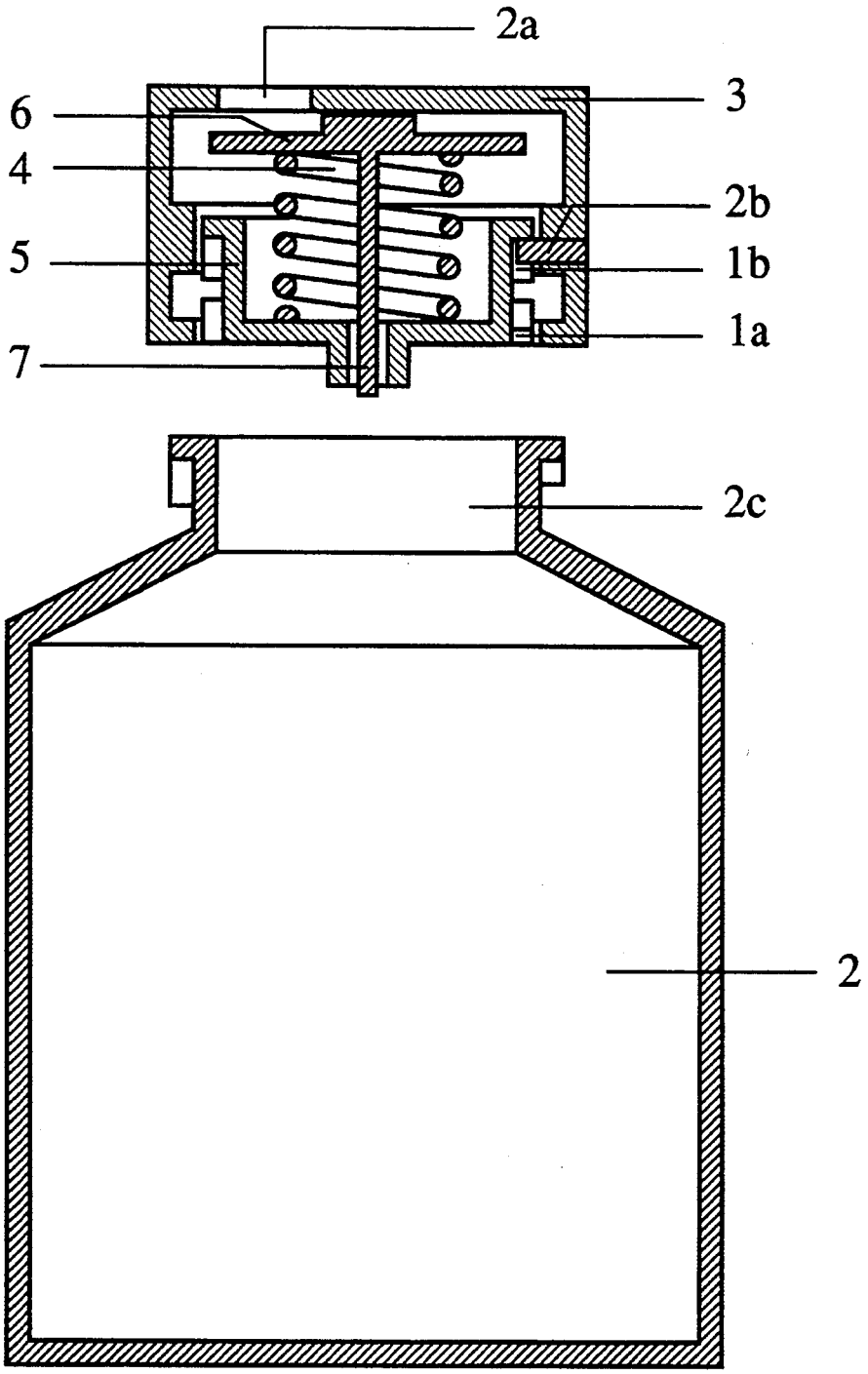
FIG. 4 shows a cross section along a diameter of the container with counter with an alternative embodiment wherein the counter is incorporated with the cap of the container instead of with the container itself.

Alternatively, especially for big containers, the counter can be incorporated with the cap of the container instead of the container itself (FIG. 4). In this case, a cylindrical structure 5 which replaces inner cylindrical container 1, together with saw-tooth structures 1*a*, 1*b*, readings 1*c*, 1*d*, and spring 4, is placed coaxially inside cap 3 (FIG. 4). Saw-tooth structures 1*a*, 1*b* are constructed on the outside surface of cylindrical structure 5. Tenon with triangular cross section 2*b* is mounted inside cap 3 on the side surface, and window 2*a* is opened where readings 1*c*, 1*d* are to be shown. Readings 1*c*, 1*d* can be shown either from the side or from the top of cap 3. In the latter case, a circular plate 6 with a handle 7 is needed (FIG. 4). On the top surface of circular plate 6 readings 1*c*, 1*d* are constructed. A neck 2*c* is also added to outer cylindrical container 2.

Figure 5A:
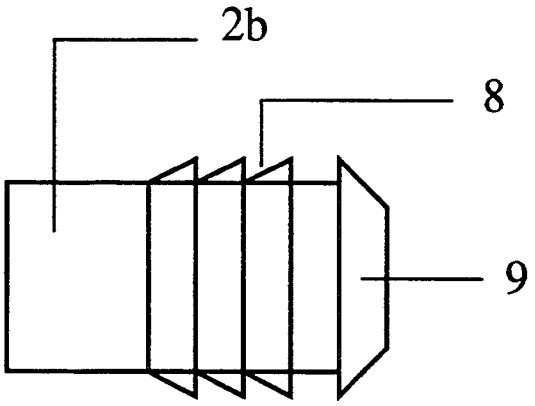
FIGS. 5A and 5B show a side and an end view of a particular design of the tenon respectively.
Figure 5B:
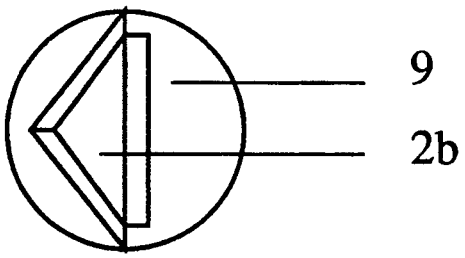

A particular design of tenon with triangular cross section 2*b* is shown in FIGS. 5A and 5B. Grooves 8 perpendicular to the length of tenon with triangular cross section 2*b* and a cap of the tenon 9 are designed so that tenon with triangular cross section 2*b* can be mounted to outer cylindrical container 2 or cap 3 by simply pushing it into a triangular hole on outer cylindrical container 2 or cap 3.

OPERATION FIG. 1 TO 4

One can open and close the container with counter in the same way as one does for ordinary containers. Every time the container with counter is opened or dosed the reading shown from window 2*a* changes and thus counting is achieved.

When the container with counter is closed, inner cylindrical container 1 is pushed in by cap 3, and when the container with counter is opened, inner cylindrical container 1 is partially pushed out by spring 4 (FIGS. 1 to 3). Accompanying these processes is a relative motion of tenon with triangular cross section 2*b* along the zagged edges of saw-tooth structures 1*a*, 1*b*, which rotates inner cylindrical container 1 clockwise and thus changes the reading shown from window 2*a*. When the container with counter is opened from the closed state and then is closed again, inner cylindrical container 1 is rotated clockwise by one reading. The reading shown from window 2*a* can be adjusted by pushing inner cylindrical container 1 half way into outer cylindrical container 2 and rotating the former counterclockwise.

The operation of the container with counter can be further illustrated when it is used as a medicine bottle. FIG. 2 shows inner cylindrical container 1 whose readings 1*c*, 1*d* can be used for medications that are to be taken three times daily. This medicine bottle can record how may times the medication stored in it has been taken daily and weekly. Every time the medicine bottle is opened or closed, the reading shown from window 2*a* changes. Thus one can check at any time if one has forgot to take certain medications. The same principle applies to medications that are to be taken other than three times daily. For medications that are to be taken once daily, for example, readings 1*c*, 1*d* can be continuous integers from 1 to 31 so that the medicine bottle can keep the record for a month. The reading shown from window 2*a* when the medicine bottle is closed can be used to indicate the medication that has been taken. The reading shown from window 2*a* when the medicine bottle is opened can be used to indicate the medication that is being taken at the moment.

The very first thing one needs to do is to adjust the reading shown from window 2*a*. Suppose one starts with one's Tuesday's first medication. When the medicine bottle is opened, make sure $$\binom{\mathrm{Tu}}{1}$$

shows up from window 2*a*. This means that one is indeed taking one's Tuesday's first medication as registered by the counter. If not, push inner cylindrical container 1 by hand half way into outer cylindrical container 2 and rotate the former counterclockwise, until the correct reading is achieved. No further adjustment is needed if one keeps the medicine bottle closed all times after the medication is taken and only open the bottle when taking the medication. Further adjustment is needed if the medicine bottle is opened when no medication is taken.

At the time for one's Tuesday's third medication, for example, before the bottle is opened, one should see that $$\left(\begin{matrix} Tu \\ 2 \end{matrix}\right)$$

shows up from window 2*a*, which means that one had taken one's second medication for Tuesday. If one sees $$\left(\begin{matrix} Tu \\ 1 \end{matrix}\right),$$

, however, this means that one has forgot to take one's second medication for Tuesday. If one opens the bottle without checking the reading beforehand, then one should see $$\binom{Tu}{3}.$$

. If $$\binom{Tu}{2}$$

shows up from window 2*a* when the medicine bottle is opened, this means, according to the counter, that one is still taking one's second medication at the time for one's third medication.

Alternatively, especially for big containers, the counter can be incorporated with the cap of the container instead of the container itself (FIG. 4). In this case, inner cylindrical container 1 is replaced by a cylindrical structure 5. When the container with counter is closed, cylindrical structure 5 is pushed inward in cap 3 by outer cylindrical container 2 and when the container with counter is opened, cylindrical structure 5 is pushed outward by spring 4. Accompanying these processes is a relative motion of tenon with triangular cross section 2*b* along the zagged edges of saw-tooth structures 1*a*, 1*b*, which rotates cylindrical structure 5 and thus changes the reading shown from window 2*a*. When the container with counter is opened from the closed state and then is closed again, cylindrical structure 5 is rotated by one reading. The reading shown from window 2*a* can be adjusted by pushing cylindrical structure 5 half way into cap 3 and rotating the former with handle 7.

SUMMARY, RAMIFICATION, AND SCOPE

The present invention, container with counter, which can record the number of times that the container has been opened or closed, is based on the idea of combining a container with a counter in such a way that the counter is triggered to advance every time the container is opened or closed. Generally the counter can be either a mechanical one or an electronic one, and the counter can be installed either in the container itself or in its cap. The triggering mechanism is provided by the opening and closing of the container, which moves a certain structure placed either in the container or in its cap, and, in the case of using an electronic counter, opens and closes an electrical switch.

Particularly the present invention uses a mechanical counter that comprises a fixed tenon, and two saw-tooth structures, each comprising a saw-tooth-like zagged edge and equal number of teeth. The saw-tooth structures are constructed and mounted on the side surface of a cylindrical structure in such a way that one is approximately the mirror image of the other with respect to a planar mirror perpendicular to the cylindrical axis of the cylindrical structure except that one is rotated around the axis by half of a tooth of the saw-tooth structures. The saw-tooth structures together with the cylindrical structure can undergo rotational motion around the cylindrical axis of the cylindrical structure and translational motion along the axis under external forces. The two zagged edges of the saw-tooth structures form a gap in which the tenon is confined and are in contact with and can slide along the fixed tenon. Therefore as the saw-tooth structures are translated back-and-forth along the cylindrical axis under external forces, there is a relative motion of the tenon along the zagged edges of the saw-tooth structures, which rotates the latter relative to the former and thus converts the back-and-forth translational motion of the saw-tooth structures to a continuous rotational motion around the cylindrical axis along a predetermined direction. The saw-tooth structures can also be rotated opposite the predetermined direction under an external torque. The mechanical counter can also comprise a hollow drum and have means of showing two-digit readings, and the capacity of the container is provided by the hollow drum.

Furthermore, the present invention, container with counter, comprises two cylindrical containers that one is placed coaxially inside the other, a cap and a spring. The saw-tooth structures and two sets of readings are constructed on the outside surface of the inner cylindrical container. One of the readings can be seen at a particular time through a window on the outer cylindrical container and different readings can be shown from the window when the entire container is opened and closed. The tenon is fixed to the outer cylindrical container. The zagged edges of the saw-tooth structures are in contact with and can slide along the fixed tenon. When the entire container is closed, the inner cylindrical container is pushed in by the cap, and when the entire container is opened, the inner cylindrical container is partially pushed out by the spring. Accompanying these processes is a relative motion of the tenon along the zagged edges of the saw-tooth structures, which rotates the inner cylindrical container relative to the outer cylindrical container and thus changes the reading shown from the window. The inner cylindrical container serves as the drum of the container and also provides the capacity of the container with counter. Typical dimensions of the container with counter are: 1.5 in. diameter and 3 in. height.

The container with counter can be used as a push button counter, if the inner cylindrical container is replaced by a cylindrical button. This push button counter can be used, for example, to record the number of openings and closings of a door or a drawer.

Alternatively, especially for big containers, the counter can be incorporated with the cap of the container instead of the container itself. In this case, a cylindrical structure which replaces the inner cylindrical container, together with the saw-tooth structures, the readings, and the spring, is placed coaxially inside the cap and can rotate freely. The zagged edges of the saw-tooth structures are constructed on the outside surface of the cylindrical structure. The tenon is mounted in side the cap on the side surface, and the window is opened where the readings are to be shown. The readings can be shown either from the side or from the top of the cap. In the latter case, a circular plate with a handle is needed. On the top surface of the circular plate the readings are constructed. For the same container several interchangeable caps with different designs for the readings can be provided so that the container can be used for different purposes. The caps with counter can also be manufactured and sold alone to replace the caps of containers without counters. Typical dimensions of the container with counter in this case are: 2~3 in. diameter and 4~5 in. height. Typical dimensions of the cap are: 2 in. diameter and $\frac{3}{4}$ in. height.

The tenon can have different geometric cross sections, such as triangular or rectangular. A typical design of it comprises a triangular cross section, some grooves and a cap. The tenon of this design can be mounted by simply pushing it into a triangular hole on the outer cylindrical container or the cap of the container, which can reduce the manufacturing cost. The tenon can be made from soft plastic materials.

The directions of rotation of the counter can be either clockwise or counterclockwise. For best reliability the directions of rotation of the counter should be along the closing direction of the cap in the case that the counter is incorporated with the container, and opposite the closing direction of the cap in the case that the counter is incorporate with the cap.

The outside surface of the outer cylindrical container and the cap of the container can be of any geometric shapes. When the counter is incorporated with the cap the container, both the inside and outside surfaces of the outer cylindrical container can be of any geometric shapes. The handle of the circular plate can have different geometric cross sections. For simplicity and easiness of handling it has a rectangular cross section.

The readings of the counter in the description are just examples for the illustration. Alternative designs, e.g., continuous numbering, can be used for different purposes. The readings can be produced by molding, printing or in the form of a sticker. A magnifier can be added to the window to aid reading. The spring can be made from either metal or plastics. The entire system can be made through molding, especially if plastic materials are used.

The container with counter can be used as a medicine bottle which is expected to be useful for people who, for various reasons, tend to forget whether or not they have taken their medications. The medicine bottle of this design can record how may times the medication stored in it has been taken daily, weekly or monthly. For medications that are to be taken once daily the readings of the counter can be integers from 1 to 31 so that the medicine bottle can keep the record for a month.

From all the descriptions it has been shown that the present invention, container with counter, can optimize structural and operational simplicities, and cost efficiency, since the container and the counter are fully incorporated together.

We claim:

1. A container apparatus constructed for recording the opening and closing thereof, comprising: an outer cylinder having a window therethrough, an axis, a closed bottom end, and an open top end, a cap for fitting onto said open top end of said outer cylinder, an inner cylinder coaxially and rotatably positioned within said outer cylinder, plural readings annularly disposed around an outer surface of said inner cylinder for sequential registration with said window, an upper annular saw-tooth structure and a lower annular saw-tooth structure mounted around said outer surface of said inner cylinder, said saw-tooth structures spaced apart along said axis, said saw-tooth structures having opposite saw-tooth edges with an equal number of teeth, said saw-tooth edges being radially offset from each other, a spring disposed within said outer cylinder for urging said inner cylinder outwardly therefrom, and a tenon mounted on an inner surface of said outer cylinder for alternately engaging and partially rotating each of said saw-tooth structures when said inner cylinder is cycled inwardly and outwardly, whereby when said cap is fitted onto said outer cylinder, said inner cylinder is pushed in by said cap and said upper annular saw-tooth structure is pushed into engagement with said tenon so that one of said readings is displayed through said window, and when said cap is removed, said spring will urge said inner cylinder outwardly until said lower annular saw-tooth structure comes into engagement with said tenon and is caused to rotate partially about said axis in a direction determined by said lower saw-tooth structure, and when said cap is replaced onto said outer cylinder, said cap will push in said inner cylinder until said upper annular saw-tooth structure comes into engagement with said tenon and is caused to partially rotate in said direction further about said axis so that another one of said readings is displayed through said window, each consecutive opening and closing cycle of said cap will cause said inner cylinder to partially rotate in said direction and sequentially display said readings one at a time through said window, thereby the opening and closing of said container is recorded by the sequential displaying of said readings.

2. The container apparatus of claim 1 wherein said readings comprise upper and lower readings, said lower readings positioned for registration with said window one at a time when said cap is removed, said upper readings positioned for registration one at a time with said window when said cap is fitted onto said outer cylinder, whereby when said container is open, one of said lower readings is displayed through said window, and when said container is closed, one of said upper readings is displayed through said window.

3. The container apparatus of claim 1 wherein said readings are selected from the group consisting of:

the seven days of a week combined with numbers indicating different weeks of a month, the seven days of a week with each day combined with numbers indicating repetitions daily, and numbers indicating a sequence of days with each day combined with numbers indicating repetitions daily, whereby automatic recording can be achieved for container openings of once daily seven days a week four weeks a month, twice to four times daily seven days a week, five times daily for six days, and six times daily for five days.

* * * * *